US006796853B1

(12) United States Patent
Tomasino

(10) Patent No.: US 6,796,853 B1
(45) Date of Patent: Sep. 28, 2004

(54) NO-CRIMP ELECTRICAL CONNECTORS AND METHOD OF MANUFACTURE

(75) Inventor: René Tomasino, Poplar Bluff, MO (US)

(73) Assignee: Swenco Products, Inc., Poplar Bluff, MO (US)

( * ) Notice: Subject to any disclaimer, the term of this patent is extended or adjusted under 35 U.S.C. 154(b) by 0 days.

(21) Appl. No.: 10/655,599

(22) Filed: Sep. 5, 2003

Related U.S. Application Data

(60) Provisional application No. 60/408,351, filed on Sep. 6, 2002.

(51) Int. Cl.[7] ..... H01R 4/38
(52) U.S. Cl. ..... 439/784; 439/805; 439/428
(58) Field of Search ..... 439/784, 805, 439/428, 727

(56) References Cited

U.S. PATENT DOCUMENTS 5,228,875 A * 7/1993 Swenson, Sr. ..... 439/784
5,695,369 A * 12/1997 Swenson, Sr. ..... 439/784
5,868,589 A * 2/1999 Swenson, Sr. ..... 439/784
6,488,548 B1 * 12/2002 Tomasino ..... 439/784

* cited by examiner

*Primary Examiner*—Gary Paumen
(74) *Attorney, Agent, or Firm*—Jim Zegeer

(57) ABSTRACT

A no-crimp electrical connector for electrically connecting first and second electrical wires. A non-conductive housing member having first and second connection chambers separated by an insulated wall. A conductive metal insert member securely mounted in the insulated wall. The insert member has first and second ends, each of the first and second ends being in the first and second connection chambers, respectively. A ball-type clamping arrangement secures a first wire in one chamber. The second end of the insert member has a wire-engaging clamp means for pressing the second wire against a surface on the second end of the insert member.

1 Claim, 9 Drawing Sheets

NO-CRIMP ELECTRICAL CONNECTORS AND METHOD OF MANUFACTURE

REFERENCE TO RELATED APPLICATION

The present invention is the subject of provisional application Ser. No. 60/408,351 filed Sep. 6, 2002 and entitled NO-CRIMP ELECTRICAL CONNECTORS AND METHOD OF MANUFACTURE.

BACKGROUND AND BRIEF DESCRIPTION OF THE INVENTION

Electrical connectors in which a hollow electrical member has a crossbore in which is seated a ball that is urged transversely through the crossbore to engage and clamp a conductor wire is known in the art. Such prior art manner of clamping the conductor wire to a conductor member usually require a crimping operation to crimp the hollow conductive member to the wire.

The present invention provides a no-crimp connector that installs with no tools, is reusable, gauge-specific in some instances, reusable on stranded or solid wires.

The object of the invention is to provide improvements over prior art electrical connectors of the ball clamp type. Another object of the invention is to provide a crimpless electrical connector which has one end adapted for solid wire and the other end adapted for stranded wires.

The invention provides a no-crimp electrical connector for electrically connecting first and second electrical wires to each other and includes a non-conductive housing member having at least first and second connection chambers separated by an insulated wall, each connection chamber having a threaded interior wall. A conductive metal insert member is securely mounted in the insulated wall. The insert member has first and second ends, each said first and second ends being in said first and second connection chambers, respectively. The first end has a wire passage having a diameter D1 for receiving the first wire. A crossbore in the first end has a ball seated therein. The ball has a diameter D2 which is larger than diameter D1, and a first threaded male member adapted to be threadedly engaged with the threads in the first connection chamber us adapted to engage the ball and cam the ball inwardly in the crossbore to engage and clamp the first wire received in the first wire passage. The second end of the insert member has a wire-engaging clamp means for pressing the second wire end against a surface on the second end of said insert member and a second hollow threaded male member adapted to engage the threads in the second connection chamber and clamp the second wire to the insert member.

BRIEF DESCRIPTION OF THE DRAWINGS

The above and other objects, advantages and features of the invention will become more apparent when considered with the accompanying drawings wherein.

DETAILED DESCRIPTION OF THE INVENTION

Figure 1A:
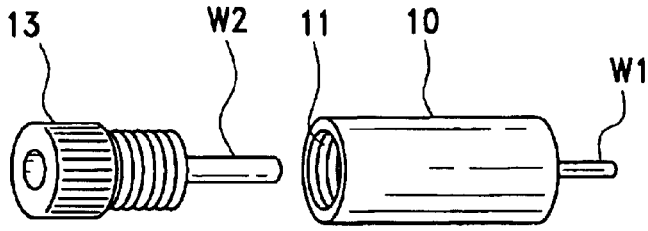
FIG. 1A (PRIOR ART)
FIG. 1A is an isometric view of a prior art connector of the crimped type.
Figure 1B:
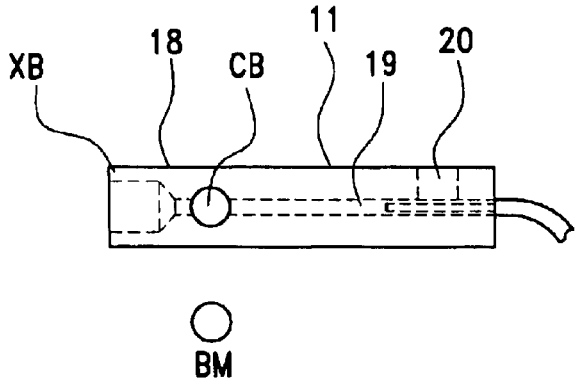
FIG. 1B (PRIOR ART)
FIG. 1B is a sectional view of the metal insert showing the crimping of the wire end.
Figure 1C:
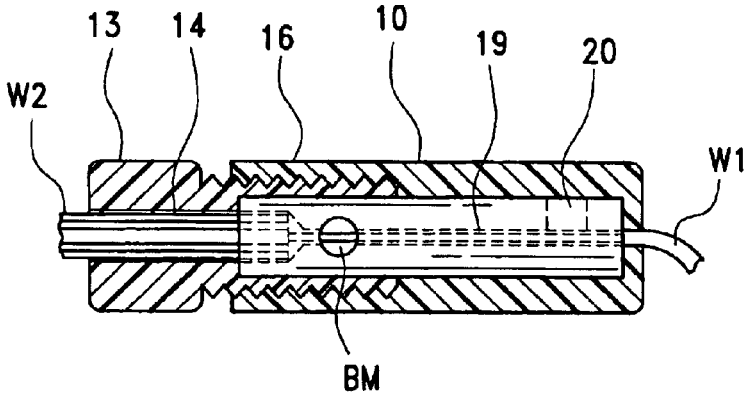
FIG. 1C (PRIOR ART)
FIG. 1C is a sectional view of the prior art connector.

Referring now FIGS. 1A, 1B and 1C, a prior art electrical connector is illustrated in which a female housing member 10 made of insulating material incorporates a crimped wire connector insert 11 therein (see FIG. 1B). A threaded male connector 13 having a throughbore 14 (FIG. 1C) has a threaded surface 15 for threaded engagement with the inner bore 16 of the female member 10. The conductive metal insert 11 has a throughbore 19 into which is threaded one end of a wire W1, and the base end of wire W1 is crimped as at 20 by a crimping tool (not shown). The opposite end 18 of the insert element 11 has a counterbore CB for receiving and guiding the bare end of a second wire W2. The throughbore 19 is intersected by a crossbore CB which is adapted to receive a ball clamp member BM. The throughbore 19 has a diameter D1 which is less than the diameter D2 of the crossbore CB. The end 25 of the male member is adapted to engage the clamp ball member BM in threaded engagement with the internal through threads 16 of the female housing member 10 and cam or urge the ball BM transversely in its bore CB so as to engage and clamp the end of the second wire W2.

THE PRESENT INVENTION

Figure 2:
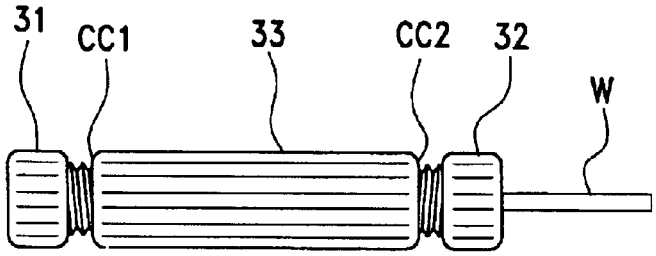
FIG. 2 is a plan view of a connector incorporating the invention.

The present invention provides a no-crimp connector that is installed with no tools, is reusable, is gauge-specific, can be used to connect stranded and/or solid wires. The connector shown in FIG. 2 includes a pair of male members 31, 32 and a female member 33 which has a threaded connection chamber at each end thereof. The male and female members are non-conductive moldings and can have knurled, round or hexheaded or triangular profiles for easy gripping. A knurled round profile is shown in FIG. 2. The female body member is threaded into each end in the connection chambers CC1 and CC2 so as to receive the respective male member 31, 32.

Figure 3:
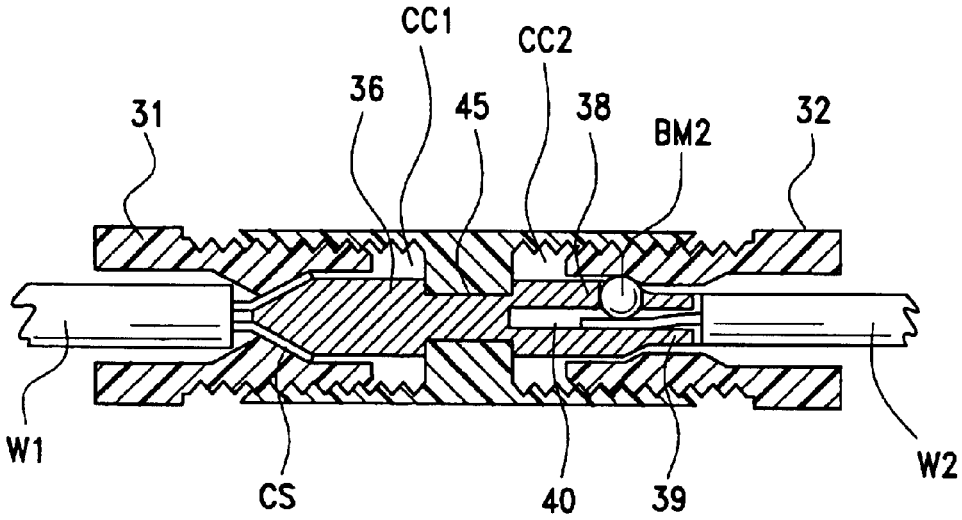
FIG. 3 is a sectional view of a first embodiment of a crimpless connector incorporating the invention.

In the embodiment shown in FIG. 3, the conductive insert member 35 has a wire-splaying end 36 in the left connection chamber CC1 and a hollow tubular connection end 38 in the right-hand side connection chamber CC2. The hollow tubular connection end 38 has a bore 39 which is adapted to funnel or feed a wire into a reduced diameter bore section 40. The reduced diameter bore section includes a crossbore CB2 into which is received a clamp ball member BM2. The wire clamping operation or function is the same as in the prior art shown in FIG. 1. This will be referred to as a "ball-type clamping arrangement". The embodiment shown in FIG. 3 is particularly adapted for connecting the stranded wire SW to a solid wire SW2; and, in this case, a solid wire is stripped and fitted into the right side of the connector and connected to the stranded wire is made in the left connection chamber section. The stranded wire is splayed on splaying end 36 and clamped thereon by rotation of male member 31 which has complementary clamping surface C3.

The insert per se is molded in the female housing member and has a reduced section 45 for retaining the insert against movement in either direction by forces acting from either end of the metal insert.

Figure 4:
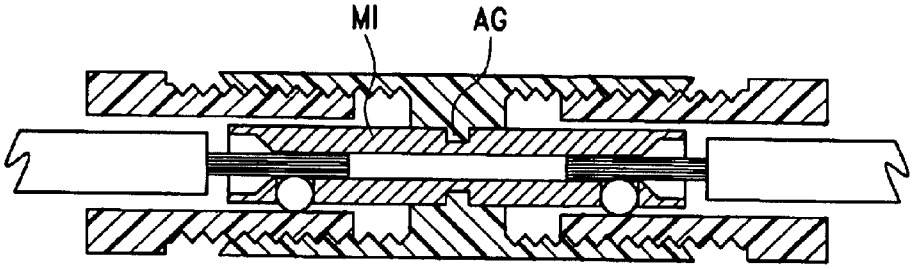
FIG. 4 is a sectional view of another embodiment of the invention.

In the embodiment shown in FIG. 4, both connection chambers house a ball-type clamping arrangement, but the metal insert MI is retained by an annular groove AG in the insert into which is flowed the insulating material during the molding of the female housing member.

Figure 5:
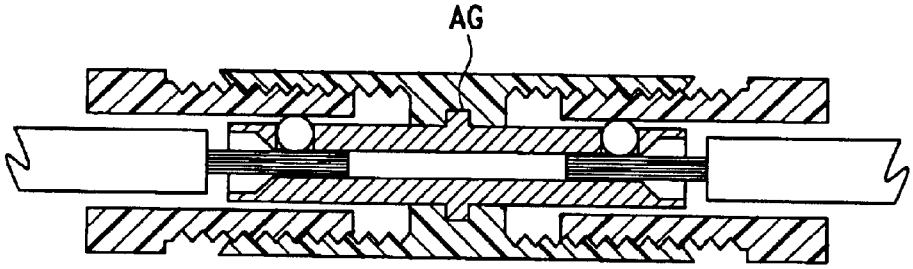
FIG. 5 is a sectional view of a further embodiment of the invention.
Figure 6:
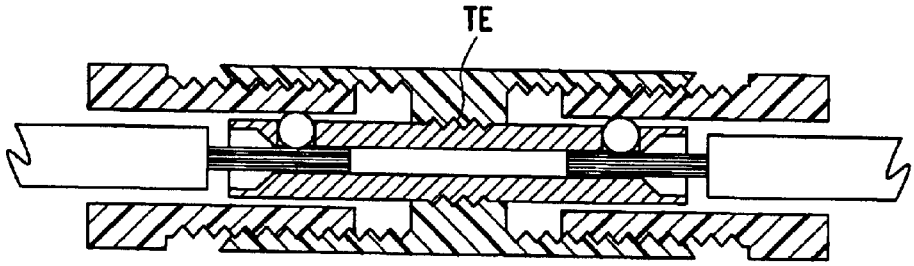
FIG. 6 is a sectional view of still another embodiment of the invention.
Figure 7:
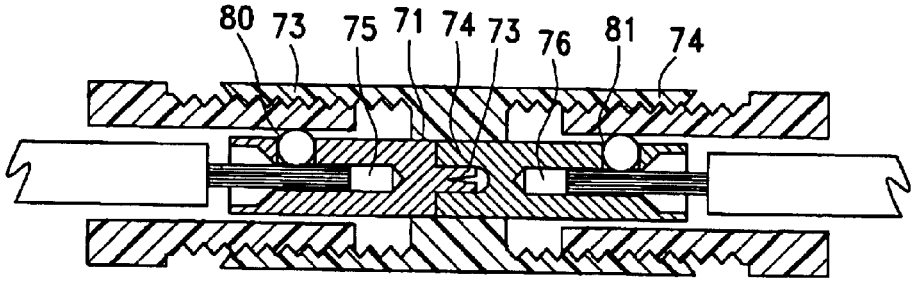
FIG. 7 is a sectional view of still a further embodiment of the invention.

In the embodiment shown in FIG. 5, the insert MI is retained in position in the female housing by an annular shoulder 45. In FIG. 6, the insert is maintained in position by a threaded exterior TE for roughening. In the embodiment shown in FIG. 7, the insert system is similar to that discussed earlier with a slot in the end of the male side for additional resistance. The conductive insert 70 in this embodiment is made in two pieces 71, 72, with male 73 and female 74 mating ends. The opposite ends are drilled with counterbores 75, 76 and crossholes 77, 78, and the male and female inserts 70, 71 can be loaded with clamp balls 80, 81 and punch-pressed in after the plastic threaded pieces are molded. In this embodiment, the combined inserts should be of the same length approximately as the female plastic body.

Figure 8A:
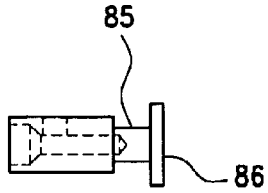
FIGS. 8A, 8B and 8C illustrate a fuse embodiment of the invention.
Figure 8B:
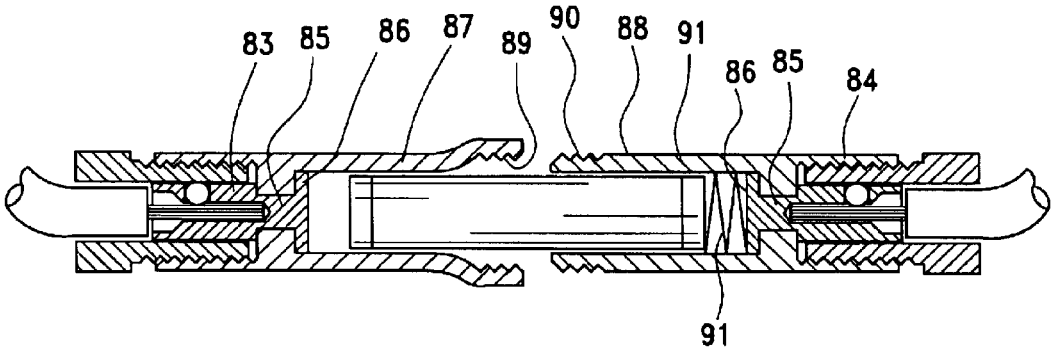
Figure 8C:
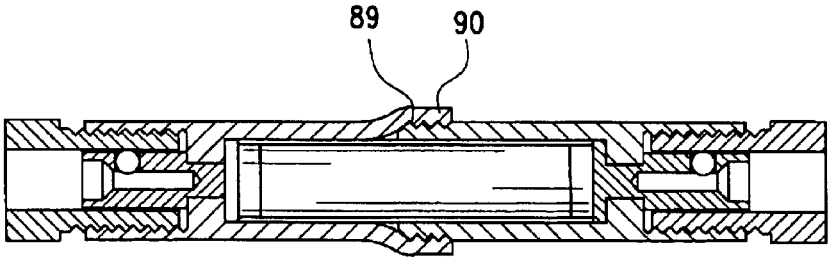

The embodiment disclosed in FIGS. 8A, 8B and 8C is a round fuseholder. In this case, the conductive inserts 83, 84 shown in section in FIG. 8A have an annular groove 85 molded with a fuse cap-engaging end or head 86 and a reduced diameter portion 85 which locks the insert in the female end of the fuseholder portion. The fuseholder is formed with a two-part housing 87, 88, each housing part 87, 88 having complementary threaded ends 89, 90 for securing the two-part housing together in the manner illustrated in FIG. 8C. A spring 91 may be included to assure good, firm electrical contact. See U.S. Pat. No. 5,868,589, incorporated hereby by reference.

Figure 9A:
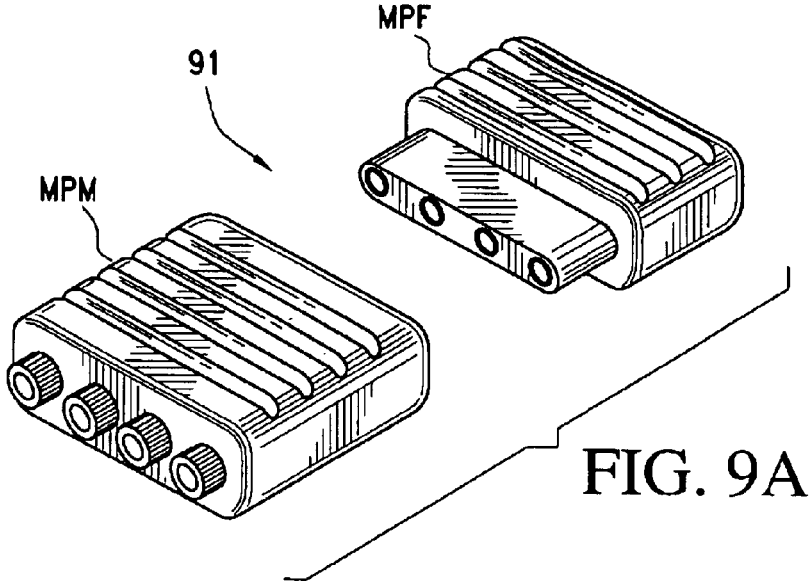
FIGS. 9A, 9B and 9C illustrate a plug-type embodiment of the invention.
Figure 9B:
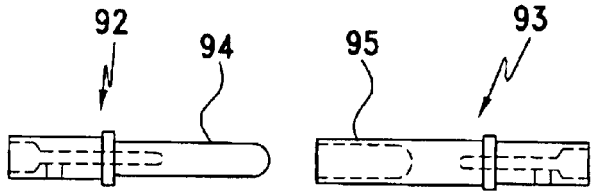
Figure 9C:
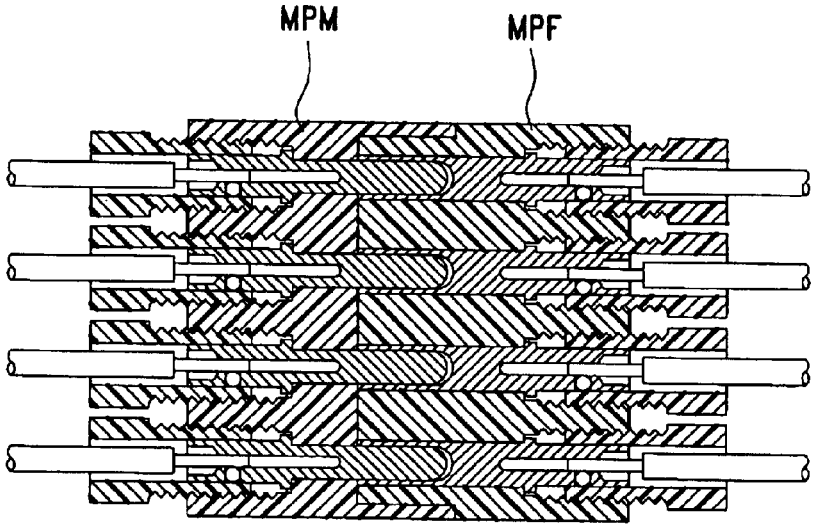

FIGS. 9A, 9B and 9C illustrate an embodiment of the invention in the form of a flat multi-plug body 91. In this case, the electrical conductive metal insert for each connection is formed in the manner illustrated in FIG. 9B. The left portion 92 is the male portion of the metal insert, and the right portion 93 is the female portion. The right and left ends of the metal inserts are formed as a male element 94 and as a female element 95 so that when they are molded in their respective plug bodies MPM, MPF, the alignment of the male element with the female conductive element is assured (FIG. 9C).

Figure 10A:
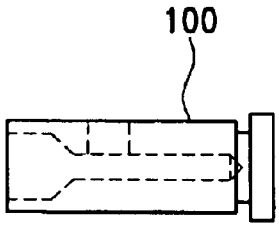
FIGS. 10A, 10B and 10C illustrate a further embodiment of the invention.
Figure 10B:
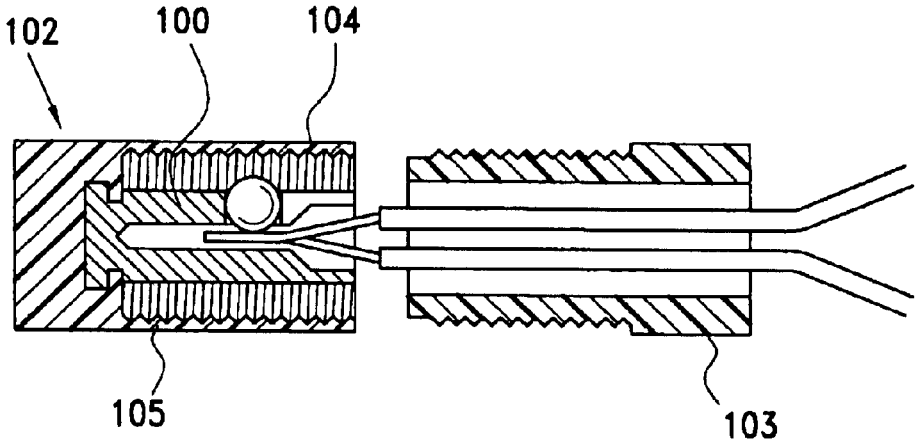
Figure 10C:
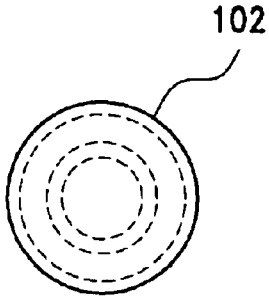

FIGS. 10A, 10B and 10C illustrate a two-wire, side-by-side connector in which two or more stranded wires are twisted together and the electrical conductive metal insert 100 is as illustrated in FIG. 10B and molded in a threaded female housing member 102. Hollow, externally threaded male member 103 is threadably engaged with the threads of female member 102 and clamp ball element 104 to clamp the twisted wires in bore 105.

Figure 11A:
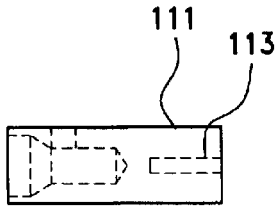
FIGS. 11A, 11B, 11C and 11D illustrate a flat fuseholder embodiment of the invention.
Figure 11B:
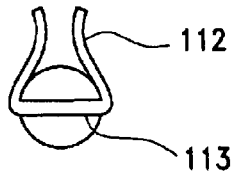
Figure 11C:
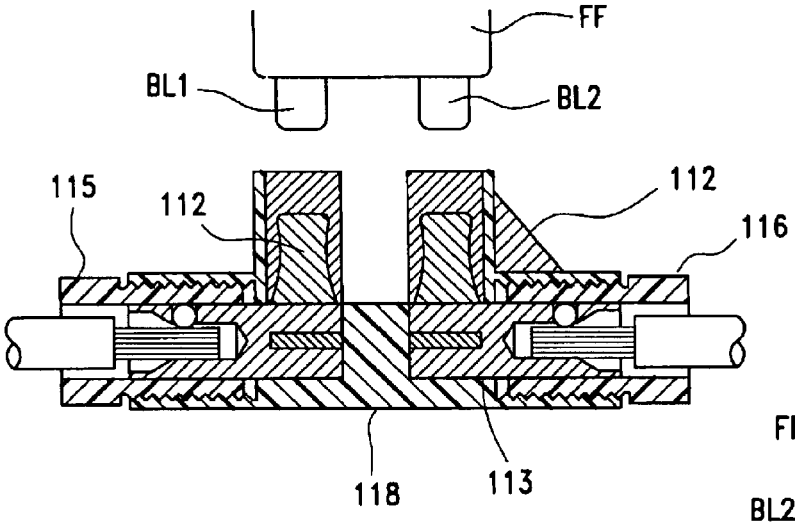
Figure 11D:
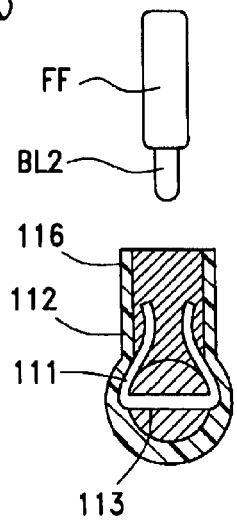

In FIGS. 11A, 11B, 11C and 11D, the conductive metal insert 111 is illustrated in FIG. 11A in a molded non-conductive body 118. The contact element for contacting the flat fuse FF blade legs BL1, BL2 is a conductive spring insert 112, U-shaped as illustrated in FIG. 11B and mounted in slot 113 in the end of insert 111. Threaded male members 115, 116 secure the wires to the connector.

Figure 12A:
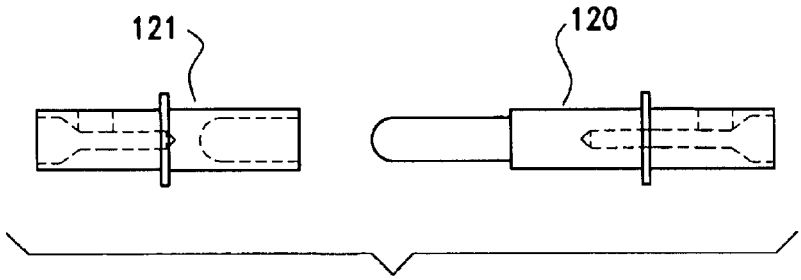
FIGS. 12A, 12B and 12C illustrate yet another embodiment of the invention.
Figure 12B:
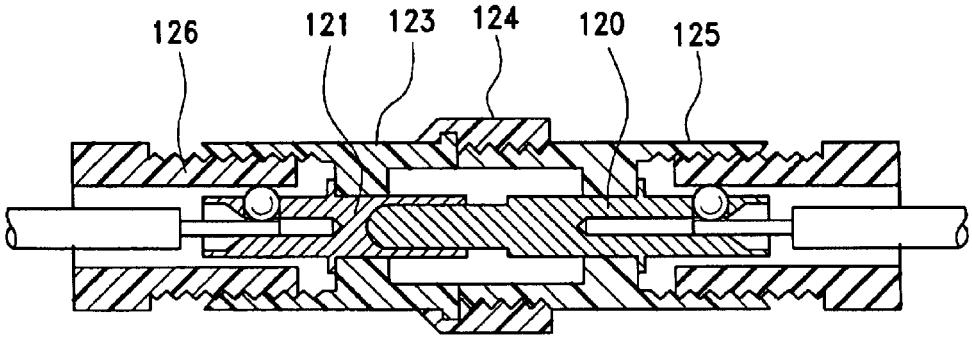
Figure 12C:
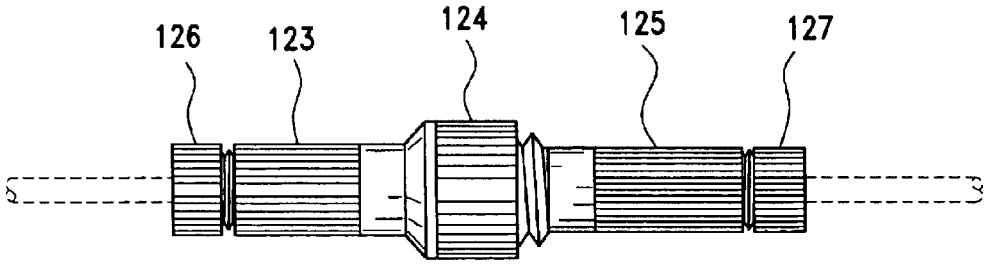

FIGS. 12A, 12B and 12C illustrate the embodiment of the invention with a crimpless quick disconnect. The left housing member 123 carries a rotatable internally threaded connector hub 124 which threadably engages external threads on right housing member 125. Male connector members 126, 127 operate as previously described.

Figure 13:
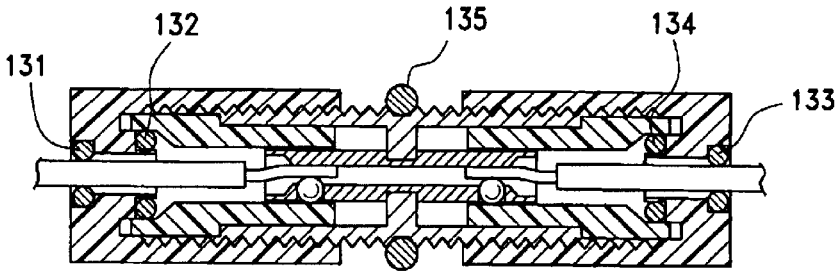
FIG. 13 illustrates another embodiment of the invention.

FIG. 13 is an embodiment of the invention in which O-rings 131, 132, 133, 134 and 135 are used to provide water-tight seal.

Figure 14:
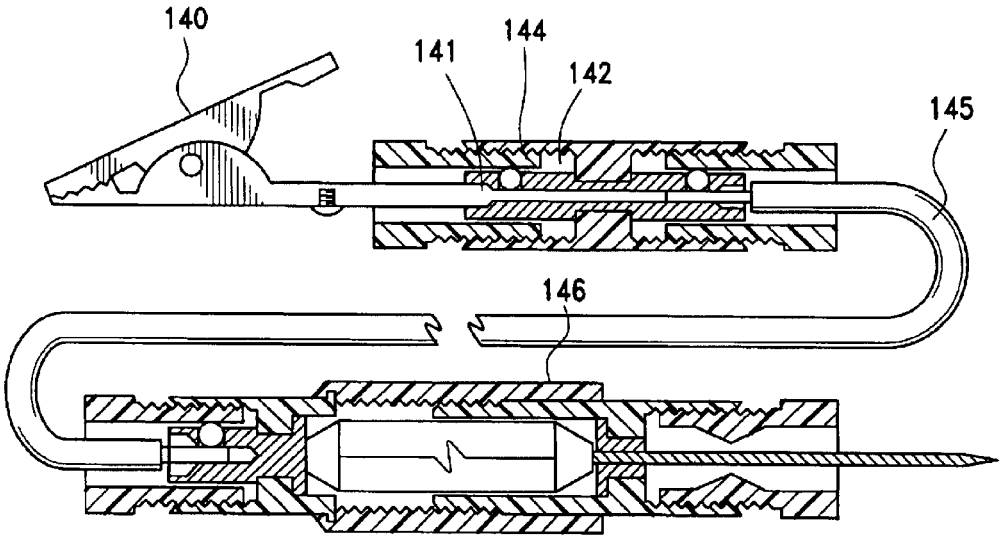
FIG. 14 illustrates still yet another embodiment of the invention incorporating the test light assembly, and FIG. 15 collectively illustrates a group of end connectors adapted for use with the invention.

FIG. 14 is an illustration of an embodiment of the invention which is used as a terminal end and continuity tester. In this embodiment an alligator clip 140 has an end 141 which is adapted to fit in the wire passage 142 and be clamped therein by ball 144 as previously described. Wire 145 extends to lamp holder 146 which has a test prod 147 mounted therein.

Figure 15:
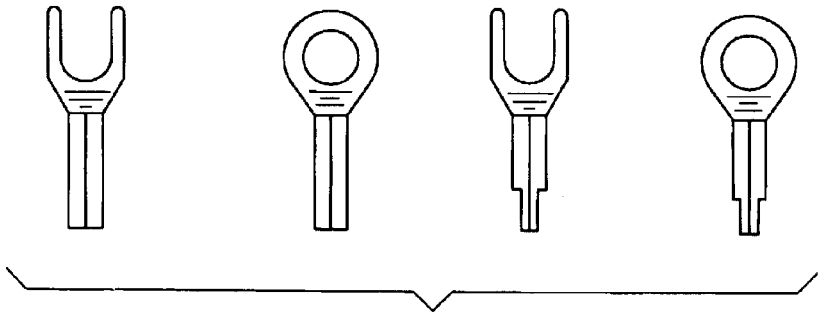

FIG. 15 illustrates various types of internals that may be used with the embodiment shown in FIG. 14 in place of the alligator clip.

While the invention has been described in relation to preferred embodiments of the invention, it will be appreciated that other embodiments, adaptations and modifications of the invention will be apparent to those skilled in the art.

What is claimed is:

1. A no-crimp electrical connector for electrically connecting first and second electrical wires to each other comprising:

a non-conductive housing member having at least first and second connection chambers separated by an insulated wall, each said connection chamber having a threaded interior wall, a conductive metal insert member securely mounted in said insulated wall, said insert member having first and second ends, each said first and second ends being in said first and second connection chambers, respectively, said first end having a wire passage having a diameter D1 for receiving said first wire, a crossbore in said first end, a ball seated in said crossbore, said ball having a diameter D2 which is larger than said diameter D1, and a first threaded male member adapted to be threadedly engaged with the threads in said first connection chamber and adapted to engage said ball and cam said ball inwardly in said crossbore to engage and clamp said first wire received in said first wire passage, said second end of said insert member having a wire-engaging clamp means for pressing said second wire against a surface on said second end of said insert member and a second hollow threaded male member adapted to engage the threads in said second connection chamber and clamp said second wire to said insert member.

* * * * *